US007241107B2

(12) United States Patent
Spanks, Jr. et al.

(10) Patent No.: US 7,241,107 B2
(45) Date of Patent: Jul. 10, 2007

(54) GAS TURBINE AIRFOIL WITH ADJUSTABLE COOLING AIR FLOW PASSAGES

(76) Inventors: William A. Spanks, Jr., 3728 Dunes Rd., Palm Beach Gardens, FL (US) 33410; Jack Wilson, Jr., 15551 79th Ter., Palm Beach Gardens, FL (US) 33418

( * ) Notice: Subject to any disclaimer, the term of this patent is extended or adjusted under 35 U.S.C. 154(b) by 69 days.

(21) Appl. No.: 11/132,774

(22) Filed: May 19, 2005

(65) Prior Publication Data

US 2006/0263217 A1 Nov. 23, 2006

(51) Int. Cl.
*F01D 5/18* (2006.01)

(52) U.S. Cl. ..... 415/115; 416/97 R; 29/889.721

(58) Field of Classification Search ..... 415/115; 416/97 R; 29/889.721
See application file for complete search history.

(56) References Cited

U.S. PATENT DOCUMENTS 5,022,817 A * 6/1991 O'Halloran ..... 415/115
6,241,469 B1 * 6/2001 Beeck et al. ..... 415/115
7,131,818 B2 * 11/2006 Cunha et al. ..... 416/97 R

* cited by examiner

*Primary Examiner*—Edward K. Look
*Assistant Examiner*—Devin Hanan

(57) ABSTRACT

An airfoil for a gas turbine engine, the airfoil includes a plurality of cooling air passages to supply cooling air to an external surface of the airfoil, the cooled surface of the airfoil having a critical temperature in which any cooled surface of the airfoil should not exceed, the cooling air passages having a coating applied within the passages, the coating being made of a material that has an oxidizing property such that the material oxidizes away and opens the passage to more flow when exposed to a temperature above the critical temperature. When the airfoil surface is not properly cooled by a flow passing through the passage, the material oxidizes away until the size of the passage increases to allow for the proper amount of cooling air to flow to cool the airfoil. Each passage is located in a different part of the airfoil that requires more or less cooling flow, and each passage will oxidize until the size of the passage is large enough to allow for the proper amount of cooling flow.

11 Claims, 2 Drawing Sheets

GAS TURBINE AIRFOIL WITH ADJUSTABLE COOLING AIR FLOW PASSAGES

CROSS-REFERENCE TO RELATED APPLICATIONS

None apply.

STATEMENT REGARDING FEDERALLY SPONSORED RESEARCH OR DEVELOPMENT

None apply.

BACKGROUND OF THE INVENTION

1. Field of the Invention

The present invention relates to an air cooled airfoil used in a gas turbine engine, and more specifically to the cooling air passages leading to an outer surface of the airfoil, the cooling air passages having a coating therein that melts away depending upon the temperature of the cooling air passing there through in order to open the cooling passage and allow for more cooling air flow.

2. Description of Related Art Including Information Disclosed Under 37 CFR 1.97 and 1.98

Blades and vanes in gas turbine engines include cooling air passages leading to an outer surface of the airfoil that requires cooling. These cooling air passages are typically located in specific locations on the airfoil where extreme high temperatures exists during operation of the engine. Certain regions of the surface require larger amounts of cooling air than other areas that require less cooling air. When designing the size of the cooling air passages, the designer typically sizes the passages to be able to supply the amount of cooling air to cool the airfoil surface under the worst case situation of highest possible heat load. This design temperature, in all likelihood, will not be reached under normal operation of the engine. Also, the heat load varies on surfaces of the airfoil, so not every surface requires the same amount of cooling air flow. Thus, the amount of cooling air passing through the passage and onto the external surface of the airfoil is more than is needed to adequately cool that area of the airfoil. Thus, cooling air flow is wasted and overall engine performance and efficiency is reduced.

U.S. Pat. No. 6,408,610 issued to Caldwell et al on Jun. 25, 2002 shows in FIG. 1 a METHOD OF ADJUSTING GAS TURBINE COMPONENT COOLING AIR FLOW, in which an airfoil includes a plurality of cooling holes having a thermal barrier coating applied at various thicknesses in the holes to provide a desired hole diameter. Under this method, the size of the cooling air passages can be designed to provide a desired amount of cooling air flow onto the surface of the airfoil—depending upon the air pressure within the blade and around the opening of the cooling air passage—such that a desired amount of cooling can occur. However, the main difference between the Caldwell invention and the present invention is that the sizes of the cooling holes do not vary based upon the operating conditions of the engine in the region of the specific cooling air passage. Under this invention, the size of the cooling air passage may be smaller than needed, resulting in less cooling air flow than required, or larger than needed, resulting in more cooling air flow than required. Either way, the engine performance or efficiency is reduced.

U.S. Pat. No. 6,416,279 issued to Weigand et al on Jul. 9, 2002 shows in FIG. 2 a COOLED GAS TURBINE COMPONENT WITH ADJUSTABLE COOLING in which the cooling air passage includes different means to vary the amount of cooling air flow during engine operation. In one method, a restrictor having an opening of specific size is placed in the cooling air passage to regulate the cooling air flow during engine operation. In this method, the size of the restrictor cannot be changed during engine operation. In another method, a control system is used and includes a temperature sensor and a control valve, where the control valve regulates an amount of cooling air flow based upon a value from the temperature sensor. The present invention is different from the Weigand invention in that no complicated air control sensors and valves are needed, or the cooling air flow can be varied during engine operation.

U.S. Pat. No. 6,485,255 issued to Care et al on Nov. 26, 2002 shows a COOLING AIR FLOW CONTROL DEVICE FOR A GAS TURBINE ENGINE in which a single shape memory metal valve is disposed in a cooling passage upstream of the many cooling air passages that open out onto the outer surface of the airfoil. In the Care invention, the valve varies the air flow depending upon temperature, but all of the cooling air passages opening onto the airfoil surfaces are controlled by this single valve. The passages exposed to the hottest surface of the airfoil are regulated by the same valve and supply airflow as the openings exposed to the coolest airfoil surface.

While all of the above mentioned prior art inventions disclose various methods to regulate the flow of cooling air onto a surface of the airfoil, none show a method or apparatus that can vary the flow of cooling air through the individual passages based upon the heat load at that individual cooling air passage.

BRIEF SUMMARY OF THE INVENTION

The present invention provides for a method of and an apparatus for regulating a flow of cooling air through the individual passages that discharge cooling air onto the outer surface of the airfoil based upon the heat load of the individual cooling air passages, and all without using and mechanical devices. This is accomplished by providing a coating in the cooling air passages, the coating being of such composition that it will oxidize at a specific temperature and melt away from the passage, thereby increasing the diameter of the cooling air passage to allow increase flow in cooling air. When the passage is sized to small to provide adequate cooling flow to the external surface of the airfoil, the temperature of the metal at the cooling passage will increase, resulting in an increase in the temperature of the air flowing through the passage. This higher air temperature flowing through the cooling passage will melt away the coating until the passage opens enough to allow the proper amount of cooling air to flow, cooling the external surface and lowering the metal temperature around the passage. When the cooling flow reaches a proper temperature, no more melting away of the coating occurs, and the proper size of the passage is reached to ensure that only the necessary flow of cooling air occurs at that specific passage.

DETAILED DESCRIPTION OF THE INVENTION

An airfoil for a gas turbine can be a rotating blade or a stationary vane. Both blades and vanes make use of cooling holes extending from a passage within the blade or vane, and extending out to a surface of the blade or vane. Cooling air flows through these holes to cool the external surface of the blade or vane, the external surface being exposed to high temperature gas flow through the gas turbine engine. The material in which an exterior surface of the airfoil is made from must have a high melting temperature to withstand the high gas temperature impacting against the airfoil surface.

For use with the disclosure of the present invention, a critical temperature is defined herein. In the design of an airfoil and a cooling system for the airfoil, a material for the airfoil surface is used that has a high melting temperature. Since the gas stream flowing through the turbine and acting against the airfoil surface is generally higher than the melting temperature of the material, cooling holes are used to deliver a cooling fluid (usually air) to the exterior surface of the airfoil. The heat applied to the airfoil surface will transfer to the material surrounding the cooling hole or passage in which the cooling fluid flows. The heat will then transfer from the material surrounding the cooling hole and into the cooling fluid. The airfoil designer would design the cooling hole of such size that the temperature of the cooling fluid flowing through the cooling hole will be at or below a critical point. If the cooling fluid temperature is above this critical point, then the external surface of the airfoil is above a desired temperature in which thermal damage could result during continuous normal operation of the engine.

Not all surfaces of the airfoil are exposed to the same temperature of gas. As such, the temperature of the metal airfoil itself will vary throughout the airfoil. The temperature of the metal near the leading edge cooling hole will be higher than the temperature of the metal near a cooling hole toward the trailing edge of the airfoil. However, all of the cooling holes are generally of the same diameter. Thus, cooling holes near relatively low temperature external gas flow have more cooling air flowing through the cooling hole than is required to cool the external surface of the airfoil near this cooling hole. A lot of power is lost in pumping extra cooling air through these holes.

Figure 1:
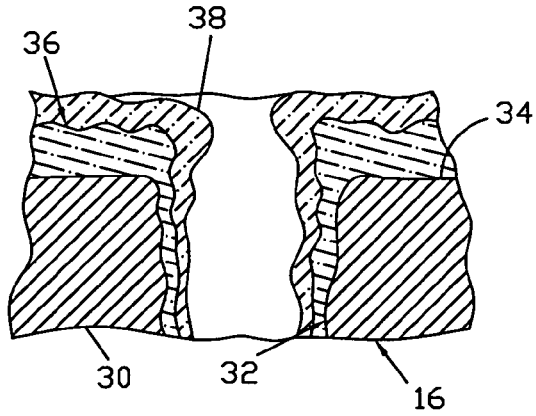
Fig 1 Prior Art
FIG. 1 shows the prior art invention of the Weigand et al U.S. Pat. No. 6,416,279.
Figure 2:
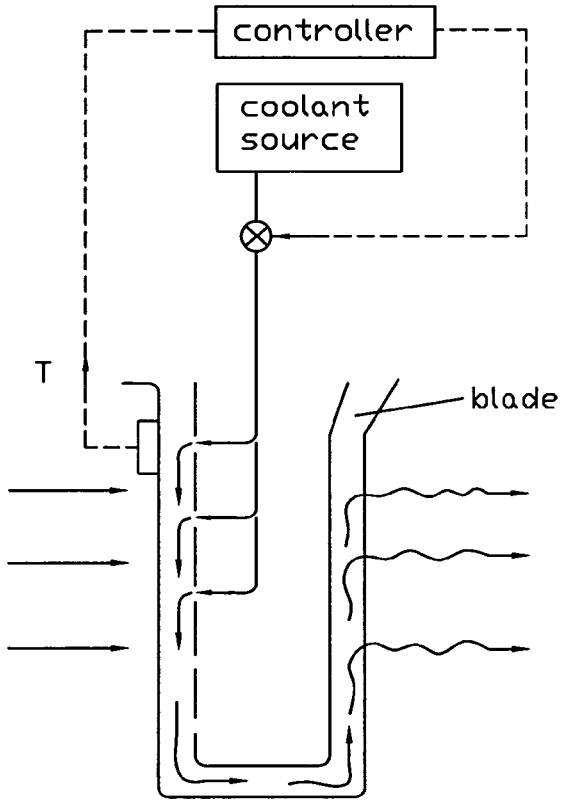
Fig 2 Prior Art
FIG. 2 shows the prior art invention of the Caldwell et al U.S. Pat. No. 6,408,610.
Figure 3:
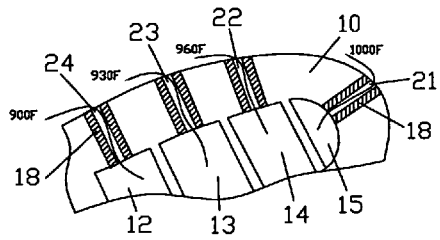
FIG. 3 shows an airfoil in an initial state of cooling with serpentine cooling passages and cooling air holes having a full width coating applied to each hole.

FIG. 3 shows an airfoil 10 with four cooling holes 21–24 located at places on the airfoil, each place being at a different temperature due to the gas flow. Each cooling hole is supplied by a different passage 12–15 in the airfoil, while each cooling hole includes a coating 18. A leading edge of the airfoil 10 is exposed to the hottest temperature due to the gas flow through the turbine, while holes further downstream have lower temperatures. Because the airfoil at the leading edge or first cooling hole 21 is exposed to a higher temperature, the metal temperature around the first cooling hole 21 will be higher, and the cooling air flowing through the first cooling hole 21 will be high. In the example of FIG. 3, the first cooling hole 21 will heat the cooling air flowing through it to a temperature of 1000 degrees F., while the second cooling hole 22 will heat the cooling air flowing through it to a temperature of 960 degrees F. The third 23 and fourth 24 cooling holes will heat the cooling air to temperatures of 930 and 900 degrees F., respectively.

Figure 4:
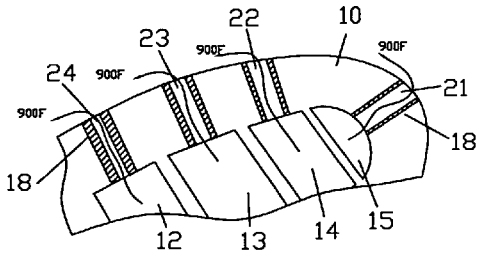
FIG. 4 shows the airfoil in the steady state of cooling with serpentine cooling passages and cooling air holes having various thickness of the coating to vary cooling air flow through the holes.

FIG. 4 shows the airfoil 10 after it has reached a steady-state condition of cooling air flow. In this example, it is desirable to operate the airfoil at a temperature such that the cooling air flowing out of the holes will be at 900 degrees F. Therefore, the coating material to use for each of the four cooling holes should have a melting temperature of just over 900 degrees F. At this melting temperature, the leading edge cooling hole that heats the cooling air flowing through it to 1000 degrees F. will result in the coating material 18 in the first cooling hole 21 to melt away until the hole is of such size to allow enough cooling air to flow through and result in the cooling air temperature to drop to just below the melting temperature of the coating material. At this point, the desirable amount of cooling air flow is reached and the proper amount of cooling air flows through the hole.

The cooling holes are coated with a material that will oxidize when a certain temperature of the cooling air flowing through the hole is reached (the critical temperature as defined above) in order that the coating material will decrease in thickness, and therefore increase the hole diameter such that more cooling air can pass through the hole. Thus, oxidation of the coating material in the cooling hole is dependent upon the temperature of the air flowing through the hole. When a high temperature gas makes contact with the external surface of the airfoil, the metal temperature of the airfoil near a certain cooling hole will increase. The temperature of the metal all along the cooling hole will increase, with the metal near the outer surface of the airfoil being higher in temperature than the metal near the inner surface of the airfoil. The high metal temperature around the hole will cause the air flowing through the hole to also increase in temperature. The coating material would be chosen such that the material oxidizes when the air flowing through the cooling hole exceeds a certain critical temperature such that more cooling air would be needed on the surface of the airfoil. Thus, the higher metal temperatures near a cooling hole causes the coating material to oxidize, and therefore the oxidation opens the cooling hole to allow more cooling air to flow. More cooling air lowers the metal temperature of the airfoil around the cooling hole. When the metal temperature around the cooling hole reaches the desired temperature limit, the temperature of the cooling air flowing through the cooling hole will be below the critical temperature, and no further oxidation of the coating will occur. Thus, the diameter of the specific cooling hole will be set such that no more than the intended cooling flow will pass through the cooling hole.

FIG. 3 shows an airfoil 10 with serpentine cooling passages 12–15 extending through the interior of the airfoil 10.

Figure 8:
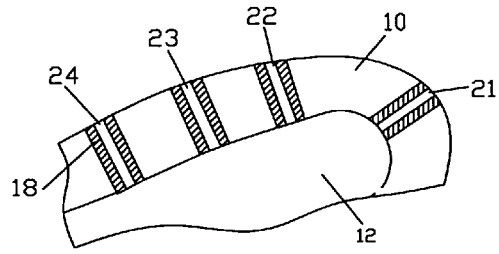
FIG. 8 shows an airfoil having cooling holes spaced around an airfoil where each hole is supplied with cooling air from a common inner passage other than a serpentine passage.

Cooling holes 21–24 extend from the serpentine passages 12–15 toward the external surface of the airfoil 10. Each cooling hole 21–24 has a material coating 18 the inside of the hole as seen in FIG. 3. The material to be used would depend upon the temperature environment that the airfoil is intended to be used in the coating would oxidize away as the temperature of the cooling air drops. When the cooling air temperatures drops to a certain temperature indicating that a proper amount of cooling air is flowing through the hole, the oxidation would cease. Thus, the size of the cooling hole would be set such that not more than the desired amount of cooling air would flow through the hole. In the FIG. 8 embodiment, only one cooling fluid supply passage 12 is shown feeding cooling air to the cooling holes 21–24.

Figures 5, 6, 7:
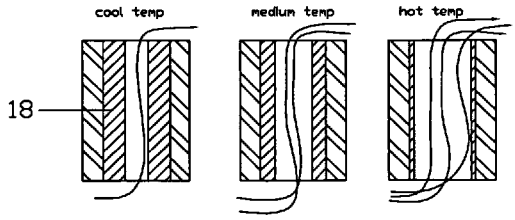
FIG. 5 shows a close-up view of the cooling hole having the coating applied therein under a low temperature environment.
FIG. 6 shows a close-up view of the cooling hole under a medium temperature environment in which the coating is partially oxidized away to allow an increase in cooling air flow.
FIG. 7 shows a close-up view of the cooling hole under a high temperature environment in which the coating is fully oxidized away to allow maximum cooling air flow.

FIGS. 5–7 show the cooling hole with various thickness of the coating material 18. In FIG. 5, the temperature near the metal surface is low, and therefore the heat transfer to the airflow in the hole is low. The cooling airflow temperature is therefore below the oxidation temperature of the coating material, and no material is oxidized. The hole is at the maximum flow resistance, so less cooling air flows through. FIG. 6 shows the cooling hole in a medium temperature environment. The metal temperature around the hole is high enough for heat transfer to increase the temperature of the cooling air flowing therethrough. Thus, the cooling air temperature is initially high enough to oxidize the coating material. As the coating material oxidizes, the diameter of the hole increases to allow more cooling air flow. This oxidation process continues until enough cooling air can flow to lower the heat transfer from the surrounding metal to the cooling air until the cooling air flow temperature drops below the oxidation temperature of the coating material. When this occurs, no more oxidation occurs, and the size of the resulting cooling hole is set. FIG. 7 show the extreme environment for the cooling hole. Here, the high temperature causes all of the coating material to oxidize, resulting in all of the coating material to be removed from the hole. Thus, the size of the hole is at a maximum, and more cooling air can flow through the hole. The maximum cooling airflow occurs due to the larger size hole.

The invention claimed is:

1. An airfoil for use in a gas turbine engine, the airfoil comprising a plurality of cooling air passages extending from an inner cooling air supply passage and leading to an outer surface of the airfoil for discharging cooling air to the outer surface of the airfoil, the outer airfoil surface being made of a material having a critical temperature, the improvement comprising:

at least one of the plurality of cooling air passages having a material coating the passage, the material having an oxidation property such that the material oxidizes at a cooling air temperature above the critical temperature, and the material having an oxidation property such that the material stops oxidizing at a cooling air temperature below the critical temperature.

2. The airfoil of claim 1 above, and further comprising: the airfoil being a stationary vane in the turbine section.

3. The airfoil of claim 1 above, and further comprising: the airfoil being a rotary blade in the turbine section.

4. The airfoil of claim 1 above, and further comprising: the airfoil includes a plurality of cooling air passages having the material coating on the passages.

5. The airfoil of claim 4 above, and further comprising: the cooling air passages are sized to provide a diameter to allow more than a desired amount of cooling air flow through the cooling air passage, and the coating is sized to provide a diameter to allow a minimum amount of cooling air flow through the passage.

6. An airfoil for use in a gas turbine engine, the airfoil comprising a plurality of cooling air passages extending from a common inner cooling air supply passage and leading to an outer surface of the airfoil for discharging cooling air to the outer surface of the airfoil, the outer surface of the airfoil being made from a material having a critical temperature, the improvement comprising:

oxidation means applied to at least one of the cooling air passages, the oxidation means oxidizing above the critical temperature of the cooling air passing through the passage and not oxidizing below the critical temperature of the cooling air passing through the passage.

7. The airfoil of claim 6 above, and further comprising: the airfoil is one of a stationary vane or a rotary blade.

8. The airfoil of claim 6 above, and further comprising: a plurality of the cooling air passages includes the oxidation means applied to the passages.

9. The airfoil of claim 8 above, and further comprising: the cooling air passages are sized to provide a diameter to allow more than a desired amount of cooling air flow through the cooling air passage, and the oxidation means is sized to provide a diameter to allow a minimum amount of cooling air flow through the passage.

10. A process for cooling an airfoil of a gas turbine engine, the airfoil having a plurality of cooling air passages to direct a cooling fluid from a cooling fluid supply passage to an external surface of the airfoil, the airfoil surface to be cooled being made of a material having a critical temperature, the process comprising the steps of:

providing for a plurality of cooling fluid passages, the cooling fluid passages having a diameter to allow for more than a desired amount of cooling fluid to flow; and, providing for a plurality of the cooling fluid passages to have an oxidizing material applied to the passages, the oxidizing material oxidizing above the critical temperature of the cooling fluid passing through the passages and not oxidizing below the critical temperature of the cooling fluid passing through the passages.

11. The process of cooling an airfoil of claim 10 above, and further comprising the step of:

providing for the oxidizing material to form a cooling fluid passage to allow for a minimum amount of cooling fluid to flow through the passages.

* * * * *